United States Patent [19]

Hashimoto

[11] Patent Number: 4,684,329

[45] Date of Patent: Aug. 4, 1987

[54] CANNED MOTOR PUMP

[75] Inventor: Kazuaki Hashimoto, Tokyo, Japan

[73] Assignee: Nikkiso Co., Ltd., Tokyo, Japan

[21] Appl. No.: 861,735

[22] Filed: May 7, 1986

Related U.S. Application Data

[63] Continuation of Ser. No. 689,722, Jan. 8, 1985, abandoned.

[51] Int. Cl.[4] ..... F04B 17/00; F04B 35/04

[52] U.S. Cl. ..... 417/357; 417/366; 417/370

[58] Field of Search ..... 417/357, 366, 368, 369, 417/370, 371, 423 R; 384/100, 114, 120, 292, 291, 388

[56] References Cited

U.S. PATENT DOCUMENTS

| | | | |
|---|---|---|---|
| 2,190,246 | 2/1940 | Schirmer | 417/370 |
| 2,669,187 | 2/1954 | Guyer | 417/357 |
| 2,939,399 | 6/1960 | Rutschi | 417/357 |
| 3,031,973 | 5/1962 | Krämer | 417/357 |
| 3,220,349 | 11/1965 | White | 417/357 |
| 3,225,698 | 12/1965 | Spisiak | 417/357 |
| 3,280,750 | 10/1966 | White | 417/357 |
| 4,047,847 | 9/1977 | Oikawa | 417/370 |

FOREIGN PATENT DOCUMENTS

| | | | |
|---|---|---|---|
| 148996 | 11/1980 | Japan | 417/369 |
| 556241 | 3/1974 | U.S.S.R. | 417/370 |

*Primary Examiner*—Carlton R. Croyle
*Assistant Examiner*—Donald E. Stout
*Attorney, Agent, or Firm*—Young & Thompson

[57] ABSTRACT

A canned motor pump has a pump section and a canned motor section connected thereto. A portion of the liquid from the pump section is diverted past a front bearing of the pump shaft and then back into the pump intake. Another portion of diverted liquid flows between the stator and the rotor in the canned motor section, and then past a rear shaft bearing, and then is returned to the pump intake. The resistance to flow of the liquid past the front bearing is made substantially greater than that past the rear bearing, so that the total flow diverted from the pump section for purpose of lubricating the front and rear bearings is substantially less than if the two resistances were equal. The resistance to liquid flow of the rear bearing can be reduced by providing it with straight channels parallel to the axis of shaft rotation, or helical channels in the direction the liquid tends to flow. The front bearing can be free from such channels, or can be provided with a helical channel in a direction in which it is different for the liquid to flow.

2 Claims, 2 Drawing Figures

CANNED MOTOR PUMP

This application is a continuation of application Ser. No. 689,722, filed Jan. 8, 1985, now abandoned.

FIELD OF THE INVENTION

This invention relates to a canned motor pump, particularly to a controlling means for a flow rate of a treating liquid to be introduced into a canned motor section in order to lubricate a bearing in the motor section and to cool the latter.

BACKGROUND OF THE INVENTION

In the canned motor pump, a portion of a pump-treating liquid is usually withdrawn from a delivery port of a pump section and introduced into a canned motor. Thereafter, the liquid portion flows over a surface of a bearing for a rotor shaft and then between a stator and a rotor. The liquid portion is then recycled to a pump system. In this case, an amount of the lubricating and cooling liquid for flowing over the bearing surface and the motor-cooling surface should be maintained at a neccessary and proper level for reducing an unwanted leakage and improving the efficiency of the pump.

From this point of view, conventional canned motor pumps have been provided at inner circumferences of their front and rear bearings with helical or axial grooves.

However, the grooves in the front and rear bearings of the conventional canned motor pumps are identical in their shapes and hence in their flow resistance. For this reason, the bearing especially on the side for introducing the treating liquid is subjected to a large pressure difference before and after the bearing, thereby to increase the unwanted excessive amount of the flowing liquid (the leakage) and to lower the designed pump efficiency. Particularly in the canned motor pump of a reverse circulation system in which a portion of the treating liquid is introduced through a junction between the pump section and the motor section into the canned motor for lubricating its front bearing, then is passed between the stator and the rotor for cooling the motor and subsequently lubricating the rear bearing, and thereafter is recycled to a suction port of the pump, the pressure drop as previously described is generated in the front bearing, thereby to increase the unwanted flow of the liquid and to lower the pump efficiency considerably.

Accordingly, an object of the invention is to provide a canned motor pump in which a flow resistance to a lubricating surface may be changed for front and rear bearings located at different pressure conditions in a motor section for minimizing the necessary amount of a lubricating liquid, thereby to reduce leakage in a pump section and to improve the pump efficiency.

SUMMARY OF THE INVENTION

The above object may be achieved, in accordance with the invention, by a canned motor pump comprising a pump section and a canned motor section connected thereto, in which a portion of a treating liquid is transported from the connected section into the canned motor section and is recycled to a lower pressure zone of the pump section after lubricating a front bearing, while the liquid portion in the canned motor section is recycled through a gap between a stator and a rotor to the suction side of the pump section after lubricating a rear bearing, the improvement in that the flow resistance to a lubricating surface of the front bearing is set higher than that of the rear bearing.

Thus, in accordance with the invention, the pump section and the motor section are connected by an adapter, from which a portion of the treating liquid is introduced into the motor section for lubricating the front bearing and then is recycled to the suction side of the pump section, while it flows through the gap between the stator and the rotor and then lubricates the rear bearing. Finally, the liquid is recycled to the suction side of the pump. In this canned motor pump according to the invention, the flow resistance to the lubricating surface of the front bearing is set higher than that of the rear bearing, so that the lubricating liquid amount may be minimized depending on the pressure of the treating liquid.

In the canned motor pump according to the invention, it is preferred that the front bearing at its inner circumference is not provided with any groove, while the rear bearing at its inner circumference is provided with a helical or straight channel which extends in the direction in which the liquid readily flows during rotation of the rotor shaft. Alternatively, the front bearing at its inner circumference may be provided with a helical channel which is directed to a difficultly flowing direction of the liquid during rotation of the rotor shaft.

Preferably, the pump section and the canned motor section are connected through an adapter, and the pump section at its rear wall is provided with a through-hole for introducing the treating liquid and with an axial through-hole for recycling the liquid portion to the lower pressure zone of the pump section after lubricating the front bearing.

In accordance with the invention, the liquid portion guided to the rear of the canned motor section and comprising the liquid after having lubricated the rear bearing may be recycled through an outside circulation tube to the suction side of the pump section.

Further, in accordance with the invention, the liquid portion guided to the rear of the canned motor section and comprising the liquid after having lubricated the rear bearing may be recycled through a central hole of the rotor shaft to the lower pressure zone of the pump section.

The invention will be described hereinbelow in more detail for the preferred embodiments with reference to the accompanying drawings.

PREFERRED EMBODIMENTS OF THE INVENTION

Figure 1:
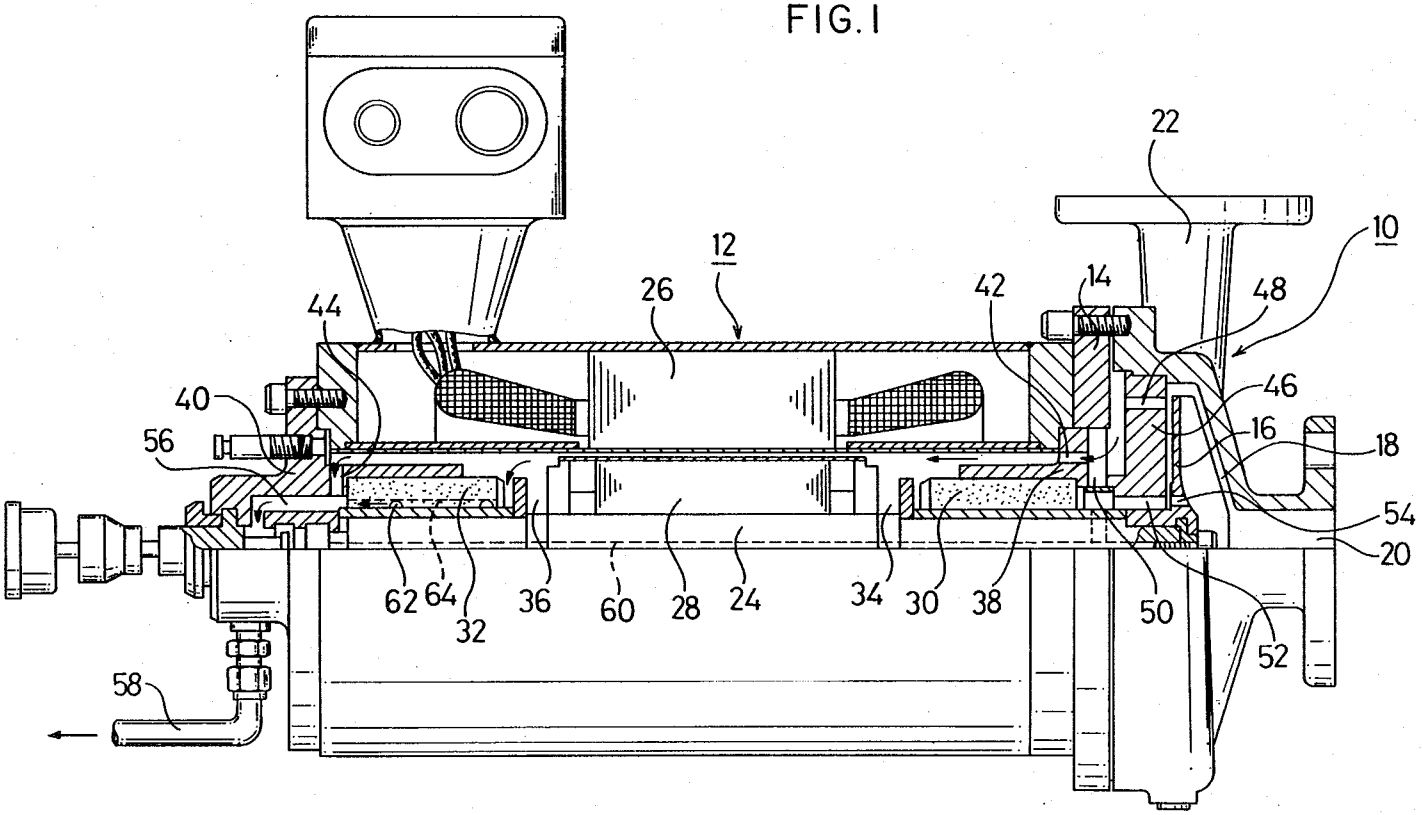
FIG. 1 is a sectional view of a main portion of one embodiment of the canned motor pump according to the invention.

FIG. 1 shows a section of one embodiment of the canned motor pump according to the invention, the basic construction of which is identical to a conventional canned motor pump. In FIG. 1, pump section 10 and canned motor section 112 are connected by an adapter 14.

The pump section 10 is provided with a suction tube 20 and a delivery tube 22, which communicate with a pump chamber 18 containing an impeller 16, while the impeller 16 is mounted on an extended end of a rotor shaft 24 in the motor section 12. On the other hand, the motor section 12 comprises a stator assembly 26 and a rotor assembly 28. The rotor shaft 24 is supported on a front bearing 30 and a rear bearing 32. The rotor assembly 28 at its either end is provided with a front rotor chamber 34 and a rear rotor chamber 36, which chambers are supported by respective bearing housings 38, 40 which in turn are provided with through-holes 42, 44 respectively for lubricating the front and rear bearings 30, 32 uniformly with the treating liquid.

The pump chamber 18 is separated from the front rotor chamber 34 by a wall 46 which on its outer side is provided with a through-hole 48. Thus, a portion of the treating liquid in the pump chamber 18 is introduced through the hole 48 into a channel 50 which is defined by the adapter 14 connecting the pump section 10 to the motor section 12. Then, the liquid is introduced through the hole 42 into the front rotor chamber 34. A portion of the liquid thus introduced into the front rotor chamber 34 lubricates the inner circumference of the front bearing 30 and flows through an axial hole 52 provided in a radially inner portion of the separating wall 46, then through a balance hole 54 provided in the impeller 16 and finally into a lower pressure zone of the pump chamber 18. The liquid portion introduced into the front rotor chamber 34 passes through a gap between the stator 26 and the rotor 28 for cooling the motor section and then into the rear rotor chamber 36. The liquid portion in the rear rotor chamber 36 lubricates the inner circumference of the rear bearing 32 and flows through the hole 44 of the bearing housing 40 into a separating chamber 56 formed by the bearing housing 40. Then, the liquid portion in the chamber 56 is recycled to the suction side of the pump system through an outer circulation tube 58. Alternatively, the liquid portion in the chamber 56 may be introduced through a center hole 60 of the rotor shaft 24 into the axial hole 52 of the wall 46 and then recycled to the lower pressure zone of the pump chamber 18.

In accordance with the invention, the quantity of treating liquid flowing over the inner circumferences of the front and rear hearings 30, 32 may be properly controlled so that, for example, the flow resistance may be set higher without the provision of any groove on the inner circumference of the front bearing 30, while the flow resistance may be set lower by the provision of either a helical groove 62 in the direction the liquid readily flows during rotation of the rotor shaft 24 or axial straight grooves 64 (as shown by a broken line) on the inner circumference of the rear bearing 32.

Thus, for the front bearing 30 a larger pressure difference may be created between the front rotor chamber 34 and the axial hole 52 communicating with the lower pressure zone of the pump chamber 18, than for the rear bearing 32. Since the flow resistance of the inner circumference forming the lubricating surface of the front bearing 30 is set higher, the quantity of the lubricating liquid for the front bearing 30 may be kept at the minimum level required. On the other hand, the pressure of the liquid fed to the rear bearing 32 is decreased during passage through the gap between the stator 26 and the rotor 28. However, since the flow resistance of the inner circumference forming the lubricated surface of the rear bearing 32 is set lower, the quantity of the lubricating liquid for the rear bearing 32 may be also kept at the required minimum level in the same way as in the front bearing 30. Thus, the circulating quantity of the treating liquid to the motor section 12, which is regarded as the leakage from the pump section 10, may be minimized, resulting in the increased efficiency of the canned motor pump.

Figure 2:
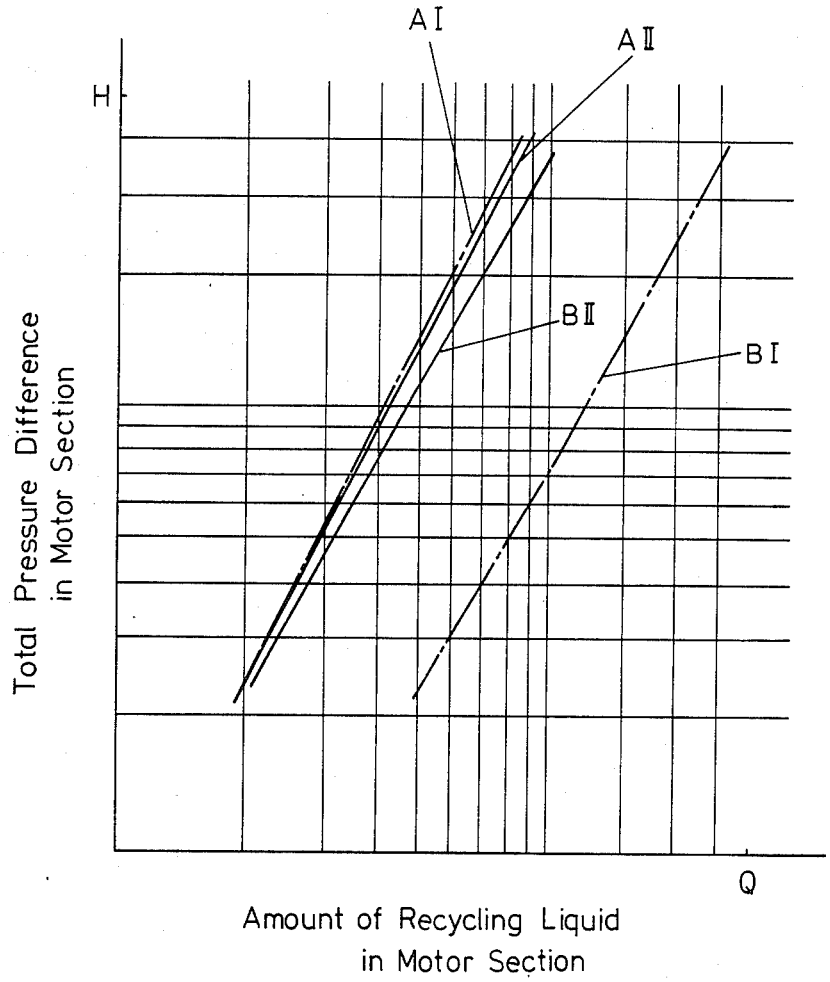
FIG. 2 is a graph for comparing the amount of the recycling liquid in a conventional pump with that of the pump according to the invention.

The flow characteristic of the motor section in the canned motor pump according to the above embodiment was compared with that of a canned motor pump having conventional front and rear bearings in order to obtain the result as shown in FIG. 2, wherein:

$A_I$ represents the quantity of the liquid flowing into the rear rotor chamber of the conventional pump;

$A_{II}$ represents the quantity of the liquid flowing into the rear rotor chamber of the pump according to the invention;

$B_I$ represents the total recycling quantity of the liquid in the conventional pump; and $B_{II}$ represents the total recycling quantity of the liquid in the pump according to the invention.

As clearly shown in FIG. 2, in accordance with the invention, the quantity of the lubricating liquid fed to the rear bearing 32 may be kept at substantially the same level as in the conventional pump, while the total recycling quantity may be reduced by at least half.

As described hereinabove, in the canned motor pump according to the invention in which the liquid portion is introduced from the front bearing side and recycled through the rear bearing to the suction side of the pump, the flow resistance of the lubricated surface of the front bearing is set higher while the flow resistance of the lubricated surface of the rear bearing is set lower, so that the quantity of the lubricating liquid may be properly adjusted depending on the pressure difference of the liquid acting on each bearing, and that the leakage of the pump section may be reduced, resulting in the considerably improved efficiency of the pump.

In the embodiment described hereinabove the groove is eliminated to increase the flow resistance to the front bearing, although a helical groove may be suitably provided in the direction of blocking the liquid during rotation of the rotor shaft.

Although the invention has been described with reference to the preferred embodiments, many variations and modifications may be made without departing from the spirit and the scope of the invention.

What is claimed is:

1. In a canned motor pump comprising a pump section and a canned motor section connected thereto, the pump and motor sections having a common shaft mounted in front and rear bearings disposed on opposite sides of a stator that surrounds a rotor carried by the shaft in the motor section, there being a gap between the stator and the rotor, the front bearing being disposed between the rotor and the pump section, means to divert a portion of the pumped liquid from the pump section and to recycle the same to a lower pressure zone of the pump section after lubricating the front bearing but without flowing through said gap, and means to divert another portion of the pumped liquid from the pump section through said gap to a lower pressure zone of the pump section after lubricating the rear bearing; the improvement in which the front bearing at its inner circumference has substantially higher resistance to liquid flow than the rear bearing at its inner circumference, and in which the rear bearing at its inner circumference has at least one channel therealong through which liquid can readily flow during rotation of the shaft, while the front bearing is free from such a channel.

2. A pump as claimed in claim 1, and an adapter interconnecting the pump section and the canned motor section, the pump section having a rear wall having a first through hole for introducing the liquid and a second through hole for returning the liquid to a lower pressure region of the pump section after lubricating the front bearing, said first hole being disposed radially outwardly of said second hole.

* * * * *